United States Patent [19]

Akiyama et al.

[11] Patent Number: 5,075,987

[45] Date of Patent: Dec. 31, 1991

[54] REMOVING APPARATUS FOR COMPRESSED SNOW AND THE LIKE

[75] Inventors: Tethuo Akiyama, Nishinomiya; Kunio Fujii, Kobe; Kiyokazu Nagai, Yao; Masayuki Imose, Kawanishi, all of Japan

[73] Assignee: Chugai Ro Co., Ltd., Osaka, Japan

[21] Appl. No.: 468,864

[22] Filed: Jan. 23, 1990

[30] Foreign Application Priority Data

Feb. 1, 1989 [JP] Japan ..... 1-23385

[51] Int. Cl.[5] ..... E01H 5/10; E01H 5/12

[52] U.S. Cl. ..... 37/227; 37/266; 37/220

[58] Field of Search ..... 37/219, 220, 226, 227, 37/228, 230, 266

[56] References Cited

U.S. PATENT DOCUMENTS

| | | | |
|---|---|---|---|
| Re. 16,081 | 5/1925 | Connolly | 37/227 |
| 645,916 | 3/1900 | Getler et al. | 37/227 X |
| 1,629,160 | 5/1927 | Heermance | 37/227 X |
| 1,722,843 | 7/1929 | Fasul | 37/227 X |
| 3,356,368 | 7/1969 | Jacques | 37/227 |
| 3,805,766 | 4/1974 | Hammon | 37/227 X |

FOREIGN PATENT DOCUMENTS

| | | | |
|---|---|---|---|
| 58844 | 7/1941 | Denmark | 37/227 |
| 62-114920 | 7/1987 | Japan . | |
| 330041 | 7/1958 | Switzerland | 37/227 |
| 386085 | 6/1973 | U.S.S.R. | 37/227 |
| 1452879 | 1/1989 | U.S.S.R. | 37/226 |

*Primary Examiner*—David H. Corbin
*Assistant Examiner*—Arlen L. Olsen
*Attorney, Agent, or Firm*—Wenderoth, Lind & Ponack

[57] ABSTRACT

An apparatus for removing compressed snow and the like, includes a steam cutter provided with a plurality of longitudinally extending steam pipes connected to a steam header, with each of the steam pipes having a steam discharging opening formed in its undersurface, and an excluding blade located behind the steam cutter. The blade is disposed at an angle of inclination with respect to an advancing direction of the removing apparatus, which angle can be adjusted.

3 Claims, 4 Drawing Sheets

REMOVING APPARATUS FOR COMPRESSED SNOW AND THE LIKE

BACKGROUND OF THE INVENTION

The present invention generally relates to an excluding unit and more particularly, to an apparatus for removing compressed snow or sheets of ice (referred to as compressed snow hereinafter) from a road.

Conventionally, various arrangements have been proposed as apparatuses for removing compressed snow or the like as referred to above. There has been disclosed, for example, in Japanese Utility Model Laid-Open Publication Jikkaisho No. 62-114920, a removing apparatus which includes a plurality of line cutting teeth provided on the undersurface of a chassis of a vehicle in a direction parallel to the advancing direction thereof, and a blade disposed behind said line cutting teeth, whereby cut lines or grooves are formed in the compressed snow or the like by the line cutting teeth for facilitating the separation of the compressed snow from the road and thereafter, the compressed snow thus treated is separated by the blade and is forced towards the side of the road.

In the known arrangement as described above, however, there has been a problem in that, since underfaces of the line cutting teeth reach and contact the surface of the paved road, the pavement and the line cutting teeth are both undesirably damaged.

In order to solve the problem referred to above, lines or grooves can be formed in the compressed snow and the like with the line cutting means being kept out of contact with the surface of the paved road; other actual methods which may be considered are as follows.

(i) Forming lines or grooves by blowing heated air against the compressed snow, etc.

(ii) Forming lines or grooves by spraying steam onto the compressed snow or the like.

(iii) Forming lines or grooves by bringing blades having heating medium circulating therethrough, into pressure contact with the compressed snow or the like.

In connection with the above, the present inventors carried out experiments for thawing ice, the employment of heated air at 700° C., steam at 120° C., and heating medium at 120° C., with findings as shown in a graph of FIG. 10, in which curves (1) and (2) represent the results as obtained by blowing hot air or steam from above the ice, while a curve (3) denotes the results when a blade through which heating medium is circulated is brought into pressure contact with the ice.

As is seen from FIG. 10, for forming line grooves of 20 mm in depth on the surface of the ice plate, more than 30 seconds are required for the method represented by curve (1), 3 to 4 seconds for the method represented by curve (2) and 6 to 7 seconds for the method represented by curve (3). Thus, as shown by the curves (2) and (3), processing speeds were almost the same as those in the conventional arrangements.

SUMMARY OF THE INVENTION

Accordingly, an essential object of the present invention is to provide a removing apparatus for removing compressed snow or the like on a road, which will not damage the surfaces of paved roads and yet is capable of removing the compressed snow, etc. in an efficient manner.

Another object of the present invention is to provide a removing apparatus of the above-described type which has a simple structure, which operates stably and with high reliability, and which can be readily manufactured at a low cost.

In accomplishing these and other objects, according to one preferred embodiment of the present invention, there is provided a removing apparatus for compressed snow and the like, which includes a steam cutter provided with a plurality of longitudinally extending steam pipes connected to a steam header with the steam pipes having steam discharging opening means formed in undersurfaces thereof, and an excluding blade means located behind the steam cutter and disposed at an angle of inclination which is adjustable with respect to an advancing direction of the removing apparatus.

According to another aspect of the present invention, the removing apparatus includes a heating medium circulation cutter provided with a plurality of longitudinally extending hollow heating medium blades connected to heating medium headers, in which heating medium at a high temperature is caused to circulate therethrough, and an excluding blade means located behind the heating medium circulation cutter and disposed at an inclination with respect to an advancing direction of the removing apparatus which is adjustable.

By the arrangement according to the present invention as described above, an improved removing apparatus which will not damage pavement has been advantageously presented, whereby disadvantages inherent in the conventional arrangements of this kind are obviated.

BRIEF DESCRIPTION OF THE DRAWINGS

These and other objects and features of the present invention will become apparent from the following description of the preferred embodiment thereof made with reference to the accompanying drawings, in which.

DETAILED DESCRIPTION OF THE PREFERRED EMBODIMENTS

Figure 1:
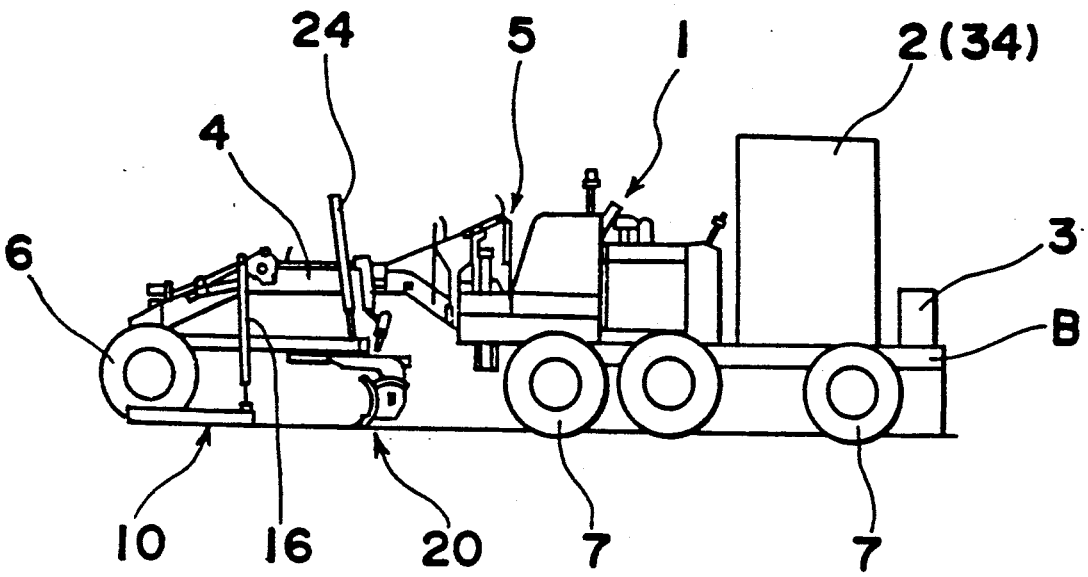
FIG. 1 is a schematic side elevational view of a removing apparatus for removing compressed snow or the like, according to one preferred embodiment of the present invention, as mounted to a front portion of a motor vehicle.
Figure 2:
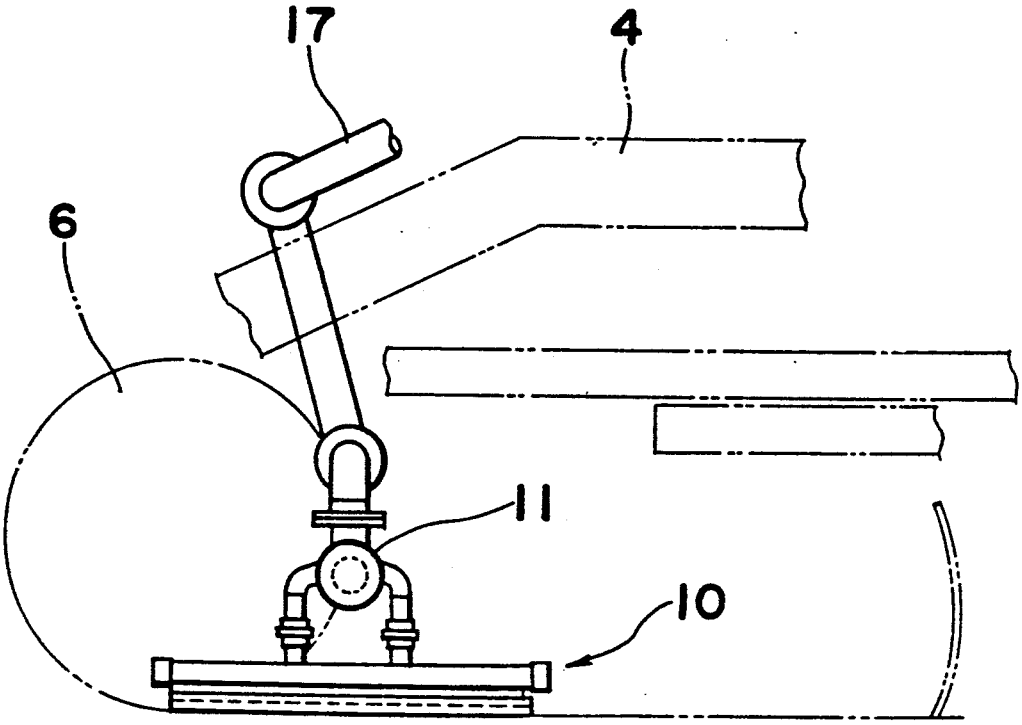
FIG. 2 is a fragmentary side elevational view showing on an enlarged scale, a front wheel of the motor vehicle, and a steam cutter and an excluding blade of the removing apparatus shown in FIG. 1.

Before the description of the present invention proceeds, it is to be noted that like parts are designated by like reference numerals throughout the accompanying drawings.

Figure 3:
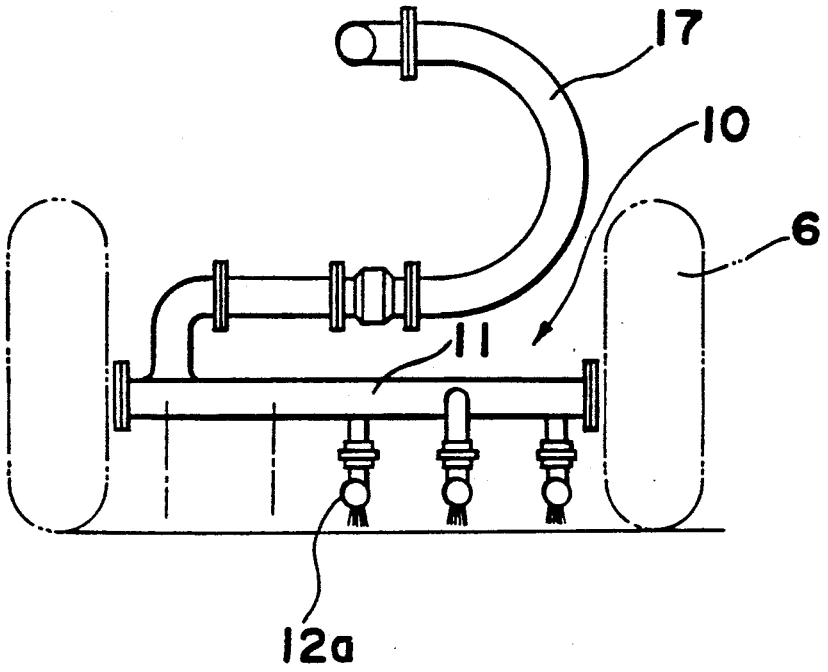
FIG. 3 is a front elevational view of a steam cutter employed in the arrangement of FIG. 1.
Figure 4:
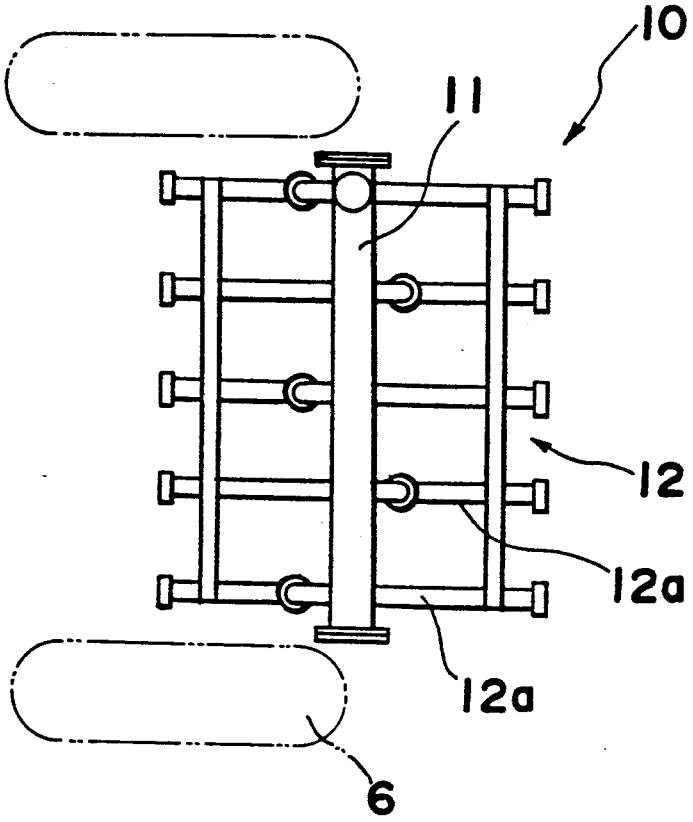
FIG. 4 is a top plan view of the steam cutter shown in FIG. 3.
Figure 5:
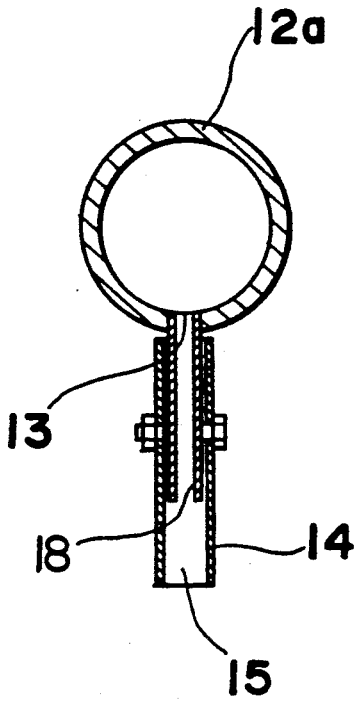
FIG. 5 is a cross section on an enlarged scale, of a steam pipe employed in the steam cutter of FIG. 1.

Referring now to the drawings, there is shown in FIG. 1, an apparatus for removing compressed snow or the like according to one preferred embodiment of the present invention, which generally includes a steam cutter 10 having a plurality of steam pipes 12*a* (FIG. 3) and an excluding blade 20, and in this embodiment, the apparatus is shown as mounted to a front portion of a motor vehicle 1.

The motor vehicle 1 is provided, on its chassis B, with a boiler 2, a fuel tank 3, and a frame 4 extending forwardly and provided, at its front end, with front wheels 6 to be operated by a handle 5, and rear wheels 7, etc. provided below the chassis B in the known manner.

The steam cutter 10 further includes a steam header 11, the plurality of steam pipes 12*a* branched from said steam header 11 and disposed in a parallel relation with each other in a running direction (i.e. in a longitudinal direction) of the motor vehicle 1, and a skirt portion 14 surrounding an elongated opening 13 in a plurality of nozzles 18 each extending from the underface of the steam pipe 12*a*.

The group 12 of the plurality of steam pipes 12*a* is attached to the frame 4 in a suspended state, for example, in such a manner that one side of the group 12 of the steam pipes 12*a* is connected to the frame 4 by a hydraulic cylinder 16, while the other side thereof is also connected thereto by another hydraulic cylinder (not shown).

Figure 7:
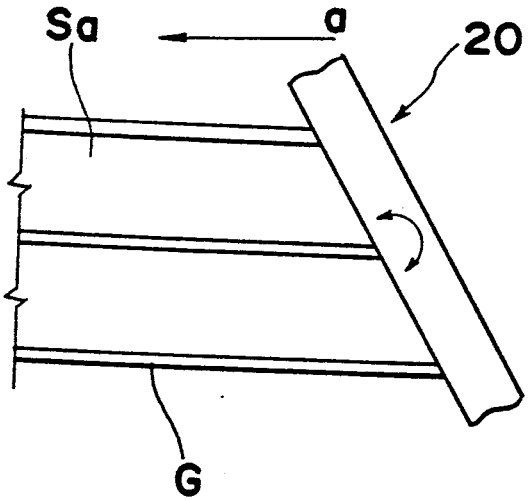
FIG. 7 is a fragmentary top plan view of the excluding blade.

The steam header 11 is connected to the boiler 2 through a piping 17 so as to allow steam (at 120° C.) from the boiler 2 to be supplied to the steam pipes 12*a* for discharging the steam onto compressed snow or the like through discharge ports 15 defined by the skirt portions 14, to thereby form a plurality of straight grooves G in the compressed snow (FIG. 7).

Figure 6:
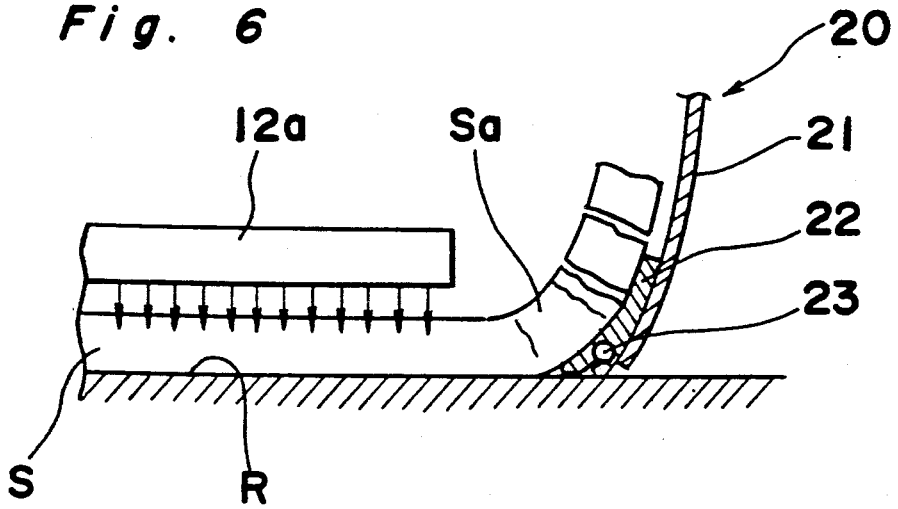
FIG. 6 is an explanatory diagram illustrating the function of an excluding blade shown in FIG. 2.

As shown in FIG. 6, the excluding blade 20 includes a blade main body 21 curved rearwardly, and a steam edge member 22 attached to the lower end of the blade main body 21. Steam is supplied into a passage 23 formed in said steam edge member 22 through piping 24 so as to be discharged forwardly after having heated the steam so as to more readily allow the snow to be separated from the road. Moreover, as shown in FIG. 7, the excluding blade 20 is disposed at an inclination relative to the advancing direction, which angle is adjustable by an angle adjusting means (not shown).

In the apparatus for removing compressed snow or the like having the structure described so far according to the first embodiment of the present invention, when the motor vehicle 1 is driven in the direction indicated by an arrow a in FIG. 7, while steam is being fed to the steam header 11, etc., from the boiler 2, the steam is discharged onto compressed snow S or the like on the surface of the pavement (paved road) R (FIG. 6) through the discharge ports 15 to form the straight grooves G in the compressed snow S as described earlier.

Meanwhile, the compressed snow S thus formed with the straight grooves G is scooped or pushed upwardly by the steam edge member 22 of the succeeding excluding blade 20 as shown in FIG. 6, and thus, the belts Sa of the compressed snow S are broken into pieces so as to be forced to the side.

When the motor vehicle 1 is to be moved to a working site or the like, the steam cutter 10 and the excluding blade 20 are positioned at the upper portion of the motor vehicle 1.

Figure 8:
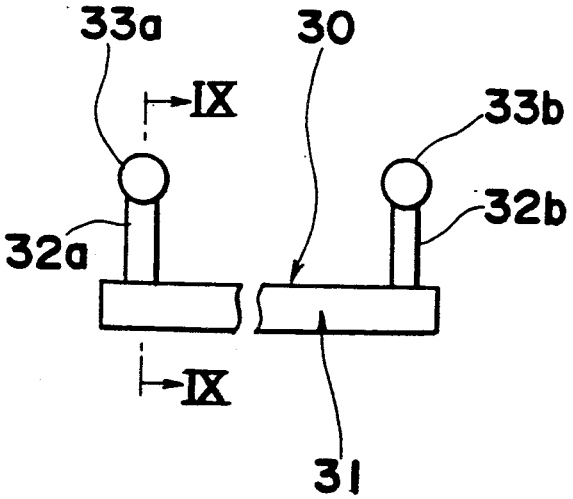
FIG. 8 is a fragmentary diagram illustrating the function of a heating medium circulation cutter employed in a modification of the present invention,.
Figure 9:
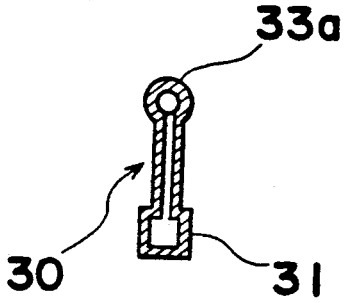
FIG. 9 is a cross section view taken along the line IX—IX in FIG. 8.
Figure 10:
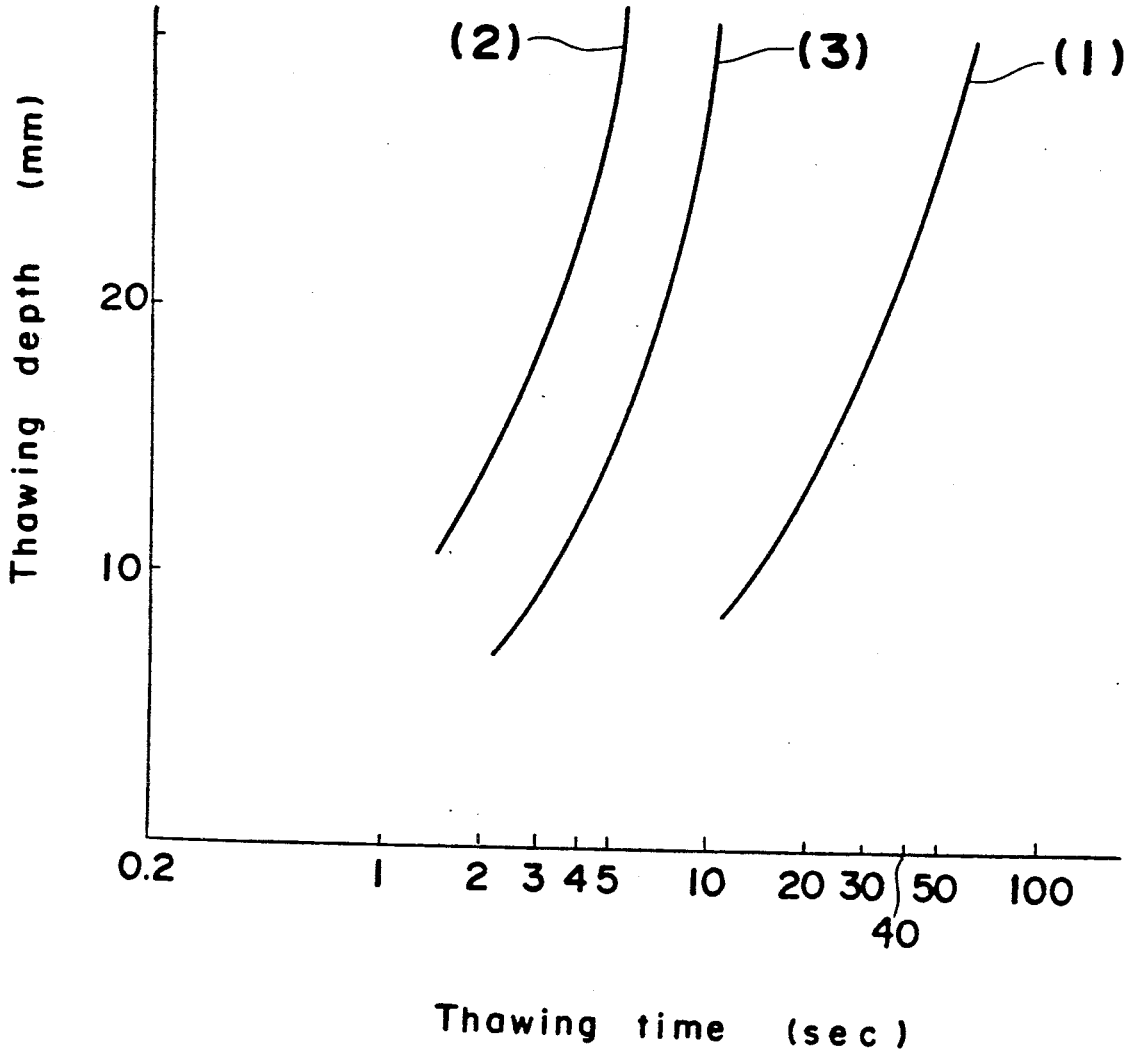
FIG. 10 is a graph showing the relation between depth of thawing of ice and thawing time based on steam spraying, heating medium contact, and heated air blowing (already referred to).

Referring further to FIGS. 8 and 9, there is shown a modification of the removing apparatus as described so far with reference to FIGS. 1 to 7.

In the modified removing apparatus, the main portions of which are shown in FIGS. 8 and 9, instead of the steam cutter 10 having the steam pipes 12*a* for spraying steam onto the compressed snow or the like to form the straight grooves G therein and described as employed in the first embodiment, there is provided a heating medium circulation cutter 30 including hollow heating medium blades 31 in which the heating medium is circulated therethrough the straight grooves G are formed by causing said blades 31 to contact the compressed snow S or the like under pressure.

More specifically, forward ends and rear ends of the plurality of hollow long heating medium blades 31 are respectively connected to two heating medium headers 33*a* and 33*b* through connecting pipes 32*a* and, 32*b* as shown in FIGS. 8 and 9. In the above case, instead of the boiler 2 in FIG. 1, a heating medium circulation boiler 34 is employed so as to feed a heating medium at high temperature (120° C.) to the heating medium header 33*a*, while the other heating medium header 33*b* is connected to said boiler 34 for returning thereto the heating medium at a lowered temperature.

Since the remaining structure and operation of the modified removing apparatus in FIGS. 8 and 9 are generally similar to those of the removing apparatus of the first embodiment, a detailed description thereof is omitted here for the sake of brevity.

As is clear from the foregoing description, according to the present invention, since the formation of grooves in the compressed snow is effected by spraying steam or by a pressure contact of heating blades therewith, the surface of a paved road is not damaged unlike in the conventional practice employing the line cutting blades.

Moreover, during formation of the grooves, heat is also conducted to the paved surface to reduce adhesion between the undersurface of the compressed snow, etc. and the paved surface, thus facilitating subsequent separation of the compressed snow by the excluding blade.

Furthermore, according to the first embodiment, since the steam to be sprayed is restricted by the skirt portions so as not to be directed sidewise, thawing of compressed snow is effected at a very high thermal efficiency.

It is to be noted here that, when the steam edge member is attached to the excluding blade as in the foregoing embodiments so as to be heated and so as to discharge the steam towards the front lower portion, separation of compressed snow or the like and the forcing of the separating snow to the side by the excluding blade may be more readily effected.

It should also be noted here that, in the foregoing embodiments, although the removing apparatus is provided at the front portion of the motor vehicle, the concept of the present invention is not limited in its application to the above arrangement alone, but the removing apparatus may be arranged to be drawn by the motor vehicle.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as included therein.

What is claimed is:

1. Apparatus for removing compressed snow or sheets of ice from the road, said apparatus comprising:

a frame;

a steam cutter supported by said frame and including a header, and a plurality of longitudinally extending steam pipes connected to said header and spaced apart from one another in a transverse direction of the apparatus, said steam pipes having steam spray means at the undersurfaces thereof for generating sprays of steam to cut a series of grooves in compressed snow or ice on a road over which the apparatus is moved; and a blade extending longitudinally at an inclination with respect to the lengthwise direction of the apparatus, said blade mounted to said frame in a manner in which the inclination thereof with respect to the lengthwise direction of the apparatus is adjustable, said blade disposed rearwardly of said steam cutter in the apparatus, and said blade having a main curved body portion that is convex toward the rear of the apparatus, an edge member attached to a lower end said body portion and projecting forwardly and downwardly in the apparatus from said lower end, and passage means, operably connected to said edge member, for heating said blade and for discharging steam to the front of said blade, said passage means comprising a passage formed through said edge member to allow passage of steam therethrough.

2. Apparatus as claimed in claim 1, wherein said steam spray means define elongate openings at the undersurface of said steam pipes, respectively.

3. Apparatus as claimed in claim 1, wherein said spray means include tubular nozzles at the undersurfaces of said steam pipes, respectively, and a respective skirt surrounding each of said nozzles.

* * * * *